US006394410B1

(12) United States Patent
Thompson

(10) Patent No.: US 6,394,410 B1
(45) Date of Patent: May 28, 2002

(54) ADJUSTABLE REINFORCEMENT INSERTION GUIDE FOR A SLIP FORM CONCRETE BARRIER MOLD

(76) Inventor: Randy L. Thompson, 310 Bonnavue Dr., Hermitage, TN (US) 37076

( * ) Notice: Subject to any disclaimer, the term of this patent is extended or adjusted under 35 U.S.C. 154(b) by 91 days.

(21) Appl. No.: 09/610,965

(22) Filed: Jul. 6, 2000

(51) Int. Cl.[7] ..... B28B 17/00

(52) U.S. Cl. ..... 249/97; 249/2; 425/63; 425/110; 404/6; 404/100; 404/105

(58) Field of Search ..... 249/2, 9, 97; 425/63, 425/110; 404/100, 105, 6

(56) References Cited

U.S. PATENT DOCUMENTS

| | | | | |
|---|---|---|---|---|
| 1,644,585 A | * | 10/1927 | Heltzel | 249/9 |
| 1,988,900 A | * | 1/1935 | Heltzel | 249/3 |
| 2,175,240 A | | 10/1939 | Arthur | |
| 2,596,206 A | | 5/1952 | Carnes | |
| 2,950,659 A | * | 8/1960 | Smiley | 404/100 |
| 3,443,495 A | | 5/1969 | Heltzel | |
| 3,678,816 A | | 7/1972 | Hudis | |
| 4,084,928 A | | 4/1978 | Petersik | |
| 4,168,135 A | | 9/1979 | Johansson | |
| 4,433,936 A | | 2/1984 | Moser | |
| 4,493,584 A | | 1/1985 | Guntert | |
| 5,993,108 A | | 11/1999 | Buhman | |

FOREIGN PATENT DOCUMENTS

| | | |
|---|---|---|
| JP | 10-220009 | 8/1998 |

* cited by examiner

*Primary Examiner*—Robert Davis
*Assistant Examiner*—Donald Heckenberg
(74) *Attorney, Agent, or Firm*—Richard C. Litman

(57) ABSTRACT

An adjustable reinforcement insertion guide is installed within the slip form mold of a mobile concrete slip form machine, for guiding steel reinforcement screens into the mold interior during the casting of continuously poured concrete barrier walls (i.e. "Jersey Walls"). The guide is vertically adjustable, in order to clear curbs, open cut joints, etc, as required. Additional adjustment is provided for a series of laterally adjustable outlet panels on the back of the guide, which provide additional accuracy and adjustment in guiding the steel mesh or screen which passes through the guide. The guide is fixed to the mobile slip form machine (with the exception of the vertical adjustment of the guide relative to the slip form machine), and travels with the machine as fresh concrete is introduced into the slip form mold of the machine.

18 Claims, 5 Drawing Sheets

ADJUSTABLE REINFORCEMENT INSERTION GUIDE FOR A SLIP FORM CONCRETE BARRIER MOLD

BACKGROUND OF THE INVENTION

1. Field of the Invention

The present invention relates generally to the concrete construction and paving fields, and more specifically to a device for use with a mobile slip form concrete barrier construction machine. The present invention secures to such a machine and serves to guide preassembled steel reinforcement grids or screens into place as the barrier is formed, placing the reinforcement accurately within the concrete barrier as it is formed.

2. Description of the Related Art

Hundreds, if not thousands, of miles of concrete traffic barrier or retaining walls (i. e., "Jersey walls") are placed or constructed annually during road and highway construction, building and parking lot construction, pavement resurfacing, etc. During temporary repaving or construction projects, most such barriers are prefabricated in predetermined lengths and temporarily placed in location as desired, using a crane or other suitable means. However, in many cases such barriers are intended for permanent placement, e. g., as dividers between opposed lanes on highways, traffic separators in areas where no shoulders exist along the roadway, as in crowded urban areas, etc.

Where such barriers are intended to be permanently installed, it is oftentimes more economical to construct the barriers in place, rather than prefabricating them in sections, transporting them to the site, and placing them as desired. As a result, machines have been developed which essentially extrude such concrete barriers as a continuous line, for use where a relatively long length of permanent barrier is desired.

The use of steel bars or other steel reinforcement in concrete structures is well known, and is known to increase the strength of concrete structures considerably. Accordingly, virtually all concrete traffic barriers or retaining walls make use of such steel reinforcement within the concrete structure. Such concrete barriers use at least a few reinforcement bars placed linearly therein, with additional steel reinforcement in the manner of one or more mats, grids, or screens being even more desirable.

While the use of reinforcing steel screens is desirable for the superior strength provided to the finished barrier, in the past their use has resulted in a relatively costly finished product. Either the contractor must buy (or make) prewelded reinforcement mats, or pour an additional footer and imbed the steel reinforcement structure in the footer and then form the concrete barrier around the reinforcement steel. Each of the above methods adds considerably to the cost of the completed job. In the case of welded steel mats, the welding reduces the strength of the steel at each welded joint, thus requiring the contractor to purchase higher strength (and more expensive) steel in order to meet the specified strength requirements of the contract. Hand tied mats are superior in this respect, but in the past have been difficult to incorporate in a concrete barrier structure without resorting to the additional step of pouring a separate concrete footer and imbedding the steel reinforcement in the footer, before pouring the barrier itself.

Accordingly, a need arises for a device for guiding placement of steel reinforcing mesh into a mobile continuous barrier forming machine, during the forming process.

The present insertion guide is installed on the forming machine and positioned between the slip form mold walls. The present invention enables two preassembled reinforcing mats to be tied together at their upper edges, with the central separator of the guide serving to separate the two mats and spread them apart at their upper edges, positioning them accurately within the concrete as it is poured continually into the slip form.

A discussion of the related art of which the present inventor is aware, and its differences and distinctions from the present invention, is provided below.

U.S. Pat. No. 2,175,240 issued on Oct. 10, 1939 to Oscar F. Arthur, titled "Apparatus For Placing Reinforcement In Concrete" describes a generally horizontally oriented machine for forcing a single ply of reinforcing mesh downwardly into a fresh concrete surface, as in a concrete roadway, floor slab, etc. The Arthur machine cannot operate in a generally vertical plane, as it is not configured to operate with a slip form barrier mold. Moreover, the Arthur machine can only handle one ply of mesh at a time, rather than the two plies which the present invention is capable of handling.

U.S. Pat. No. 2,596,206 issued on May 13, 1952 to Fred D. Carnes, titled "Dowel Bar Installing Device," describes a machine for placing dowel and tie bars into a horizontal poured concrete structure (paving, slab, footing, etc.). The device comprises a series of hooked fingers each supporting a dowel rod or the like, with the rods sliding from the hooks when they contact the fresh concrete. Each hook has an upper part which engages the rods to force them downwardly into the concrete, with the fingers clearing the rods when the fingers are lifted from the concrete. The Carnes machine cannot insert two plies of steel reinforcing mesh or screen into opposite sides of a concrete structure, nor can it install such reinforcing steel in a generally vertical structure or into a structure as it is being formed, as provided by the present guide.

U.S. Pat. No. 3,443,495 issued on May 13, 1969 to Carl J. Heltzel, titled "Concrete Reinforcing Steel Handling And Placing Device," describes a machine for picking up reinforcement bars and the like and carrying them over freshly poured concrete, and placing them atop the concrete. The Heltzel machine does not actually place or locate the reinforcement bars within the concrete; this must be done by a separate machine. The Heltzel machine cannot be used with generally vertical concrete structures, as it merely places the reinforcement material atop a freshly poured horizontal slab. Also, the Heltzel machine cannot provide more than a single ply of reinforcement steel for the concrete, as the ply of steel placed is defined by the upper layer of fresh concrete upon which the steel is placed by the Heltzel device.

U.S. Pat. No. 3,678,816 issued on Jul. 25, 1972 to Michael I. Hudis, titled "Apparatus For Installing Reinforcing In Plastic Concrete," describes a machine for depressing reinforcing rods or bars into freshly poured concrete, comprising a wheel having a series of paddles thereon for pushing the steel reinforcement into the concrete. The Hudis device thus performs essentially the same function as the devices of the Arthur '240 and Carnes '206 U.S. Patents discussed further above, and cannot guide or feed multiple plies of preassembled steel reinforcing mesh or screen into a generally vertical concrete structure as it is being continually and linearly formed, as provided by the present insertion guide invention.

U.S. Pat. No. 4,084,928 issued on Apr. 18, 1978 to Adolph R. Petersik, titled "Slip Form Having Reinforcement Accommodating Means," describes a slip form mold having a hinged door or panel on the forward end thereof. The door includes slots and passages therein, for allowing continuous lengths of reinforcing rod or bar to pass through the closed door and into the mold, where it is encapsulated within the concrete. The slots of the door of the Petersik device extend laterally, with the ends being closed off when the door is closed. Thus, the Petersik device does not provide clearance thereinto for multiple plies of continuous preformed screens or meshes having a length and substantial width, as provided by the present insertion guide. Moreover, the Petersik device cannot be lifted for obstruction clearance (curbs, etc.) while in operation, as can the present reinforcement insertion guide.

U.S. Pat. No. 4,168,135 issued on Sep. 18, 1979 to Henry S. Johansson et al., titled "Casting Machine With Reinforcement Inserting Device," describes a device for inserting transverse tie bars into freshly poured concrete, in a slip form mold for forming concrete barriers. The device is external to the mold, rather than being installed within the mold as in the case of the present invention. The Johansson et al. machine deposits a series of separate, single reinforcement bars transversely atop the fresh concrete and forces them downwardly into the concrete. The Johansson et al. device does not serve as a guide for accurately positioning continuous lengths of reinforcement grid or screen material longitudinally into the length of the barrier as it is poured, as provided by the present reinforcement insertion guide.

U.S. Pat. No. 4,433,936 issued on Feb. 28, 1984 to Andreas Moser, titled "Device For Driving And Positioning Dowels Into Concrete Slabs," describes a machine which performs a similar function to that of the Arthur '240, Carnes '206, and Heltzel '495 U.S. Patents discussed further above. As in those other devices, the Moser machine inserts relatively short lengths of lateral reinforcing rod from above, vertically downwardly into a freshly poured slab of concrete as in a roadway, foundation, etc. The Moser machine, as with the others noted above, is incapable of guiding continuous lengths of reinforcement screens disposed generally on edge into a slip form mold for forming a generally vertical concrete barrier wall, as provided by the present insertion guide invention.

U.S. Pat. No. 4,493,584 issued on Jan. 15, 1985 to Ronald M. Guntert, titled "Apparatus And Process For Dowel Insertions," describes an automatic feeder machine which singly picks up dowels from a supply of such dowels, and distributes and inserts them into a freshly poured concrete slab from above. The Guntert machine thus bears a closer resemblance to the machines of the Carnes '206, Heltzel '495, and Moser '936 U.S. Patents, than to the present invention. As in the other devices discussed to this point, the Guntert machine cannot be used as a guide for the insertion of continuous lengths of reinforcing steel mesh or screens into the leading end of a concrete barrier slip form machine, as provided by the present insertion guide invention.

U.S. Pat. No. 5,993,108 issued on Nov. 30, 1999 to Gerald L. Buhman, titled "Dowell (sic) Rod Inserter," describes a pneumatic device for securing to the side of a slip form concrete casting machine, such as a curb or pavement forming machine. The Buhman device extends laterally from the slip form, and inserts dowels singly and laterally into the plastic concrete through a slot in the side of the slip form, before the concrete has cured. As in the case of the other prior art devices known to the present inventor, the Buhman device is incapable of guiding one or more elongate prefabricated steel reinforcement grids or screens longitudinally into the leading end of a slip form, which function is provided by the present insertion guide invention.

Finally, Japanese Patent Publication No. 10-220,009 published on Aug. 18, 1998 to Oriental Construction Company, Ltd. et al., describes (according to the drawings and English abstract) the formation of a pocket in a concrete structure, into which a jack is placed. The jack applies compressive force to a reinforcing rod installed in the concrete structure, to apply stress to the concrete for greater strength. The apparatus and method of the '009 Japanese Patent Publication is not closely related to the present invention, as the concrete structure to which the reinforcing steel is applied is not stressed in the present invention, and the steel reinforcement is applied to plastic, uncured concrete in the present invention, as opposed to the application of the Japanese apparatus and method to cured concrete.

None of the above inventions and patents, taken either singly or in combination, is seen to describe the instant invention as claimed.

SUMMARY OF THE INVENTION

The present invention comprises an adjustable reinforcement insertion guide for use with mobile slip form machines for forming continuous lengths of concrete barrier walls (i. e., "Jersey walls"). The present invention provides a means for accurately guiding the placement of prefabricated reinforcement steel screens or grids into the leading end of such a mobile slip form machine, thereby providing superior strength to the resulting cured concrete barrier.

The present insertion guide installs within the leading end of a slip form mold, and includes inlet guide panels for accurately guiding and placing the steel reinforcement structures into the slip form mold as the concrete is being introduced therein. The present guide is adjustable, with the height being vertically adjustable in order to provide clearance and accurate spacing for curbs, open cut joints, etc. as required. The device also includes adjustable rearward guide panels, which may be adjusted laterally to provide more accurate guidance and placement for the steel reinforcement as it passes through the guide. The present guide is the only device of which the present inventor is aware, which is capable of accurately placing two prefabricated steel reinforcement screens within a slip form mold simultaneously, without requiring prior preparation as by setting up the reinforcement in previously poured footings, etc.

Accordingly, it is a principal object of the invention to provide an improved reinforcement insertion guide for use with a slip form concrete barrier mold, for accurately guiding steel reinforcement into the slip form.

It is another object of the invention to provide an improved reinforcement insertion guide which is vertically adjustable to provide clearance for curbs and the like as required.

It is a further object of the invention to provide an improved reinforcement insertion guide which vertical adjustment is accomplished by hydraulic means.

An additional object of the invention is to provide an improved insertion guide including further adjustment means for guiding the steel reinforcement laterally through the guide.

Still another object of the invention is to provide an improved reinforcement insertion guide which provides for the insertion of two laterally spaced steel reinforcement screens simultaneously to each side of the center of the mold.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
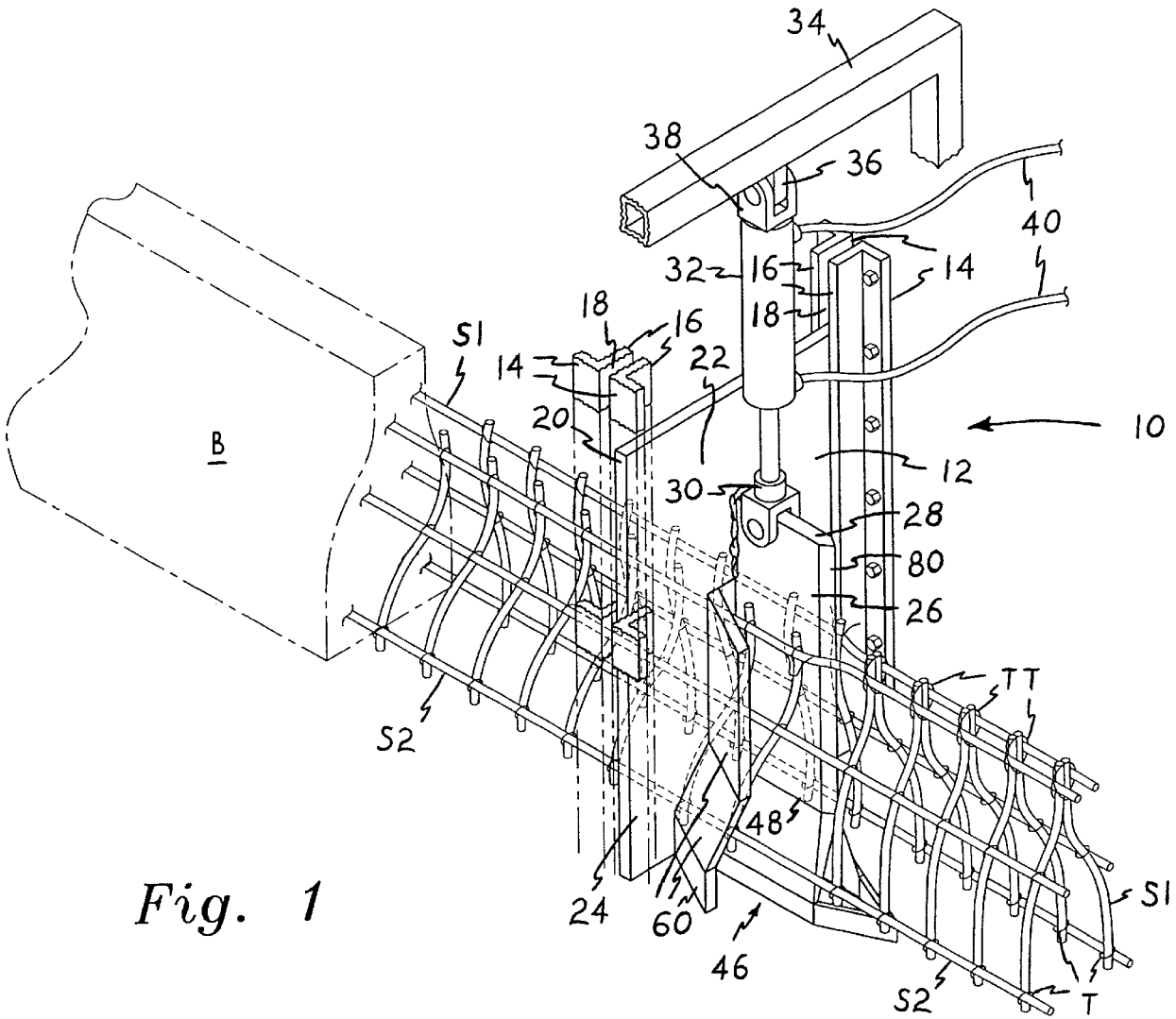
FIG. 1 is a front and right side perspective view of the present reinforcement guide invention, showing its structure and operation in guiding steel reinforcement screens therethrough.

The present invention comprises a guide which is installed within the slip form mold of a mobile continuous feed machine for forming continuous lengths of concrete barrier walls (e. g., "Jersey walls"), as in the construction and repair of roadways and the like. The present invention is indicated generally by the reference numeral 10 throughout the drawings, and provides for the insertion of essentially continuous lengths of steel reinforcing screens into the leading end of the slip form mold to provide reinforcement of the completed barrier. As the slip form machine generally surrounds the present reinforcement insertion guide 10 when the guide 10 is installed with the slip form machine, most of the conventional slip form machine is not shown in the drawings in order to provide clear views of the present guide 10.

FIG. 1 provides a front, top, and right side perspective view of the present guide 10. The guide 10 is preferably vertically adjustable, with a generally vertically oriented slide gate 12 secured between the two slip form molding walls W1 and W2 of the slip form machine, with the walls W1 and W2 being shown in the top plan view of FIG. 3 and front and rear elevation views respectively of FIGS. 4 and 5. A pair of opposed angles 14 are secured to the interior of each of the slip form mold walls W1 and W2, with their four inwardly extending flanges 16 defining two facing slide gate slots 18 therebetween. The lateral edges 20 of the slide gate 12 ride within the opposed slots 18 defined by the angles 14, to provide vertical adjustment for the slide gate 12.

The slide gate 12 has a laterally continuous upper portion 22 spanning the distance across the slip form walls W1 and W2 between the two slide gate slots 18. Opposite first and second lower side panels 24 depend from each side of the upper portion 22 of the slide gate 12 and slide in their respective slots 18. The upper portion 22 of the slide gate 12 has a reinforcement screen guide blade 26 extending forwardly and downwardly therefrom, with the blade 26 oriented substantially vertically and orthogonally to the plane of the slide gate 12, as shown in the drawings. The upper or slide plate attachment end 28 of the blade 26 is permanently and rigidly affixed (e. g., welding, etc.) to the front of the upper portion 22 of the slide gate 12, with the lower strut or second end 30 of a hydraulic cylinder 32 attaching directly to the upper end 28 of the guide blade 26 and thus indirectly to the slide plate 12.

An overhead frame 34 (shown partially in FIGS. 1 and 2) spans the distance between the two walls W1 and W2 of the slip form machine, and is immovably affixed relative to the slip form machine. The means for attaching the frame 34 to the slip form machine are conventional, e. g., welding, bolting, etc. The frame 34 center includes an attachment bracket 36 depending therefrom, with the upper or first end 38 of the hydraulic cylinder 32 being secured to the bracket 36. The hydraulic cylinder 32 is actuated conventionally by means of hydraulic lines 40, thus allowing the slide gate 12 to be adjusted vertically between the two walls W1 and W2 of the slip form machine to adjust for discontinuities in the underlying surface, such as curbs, catch basins, etc.

Figure 4:
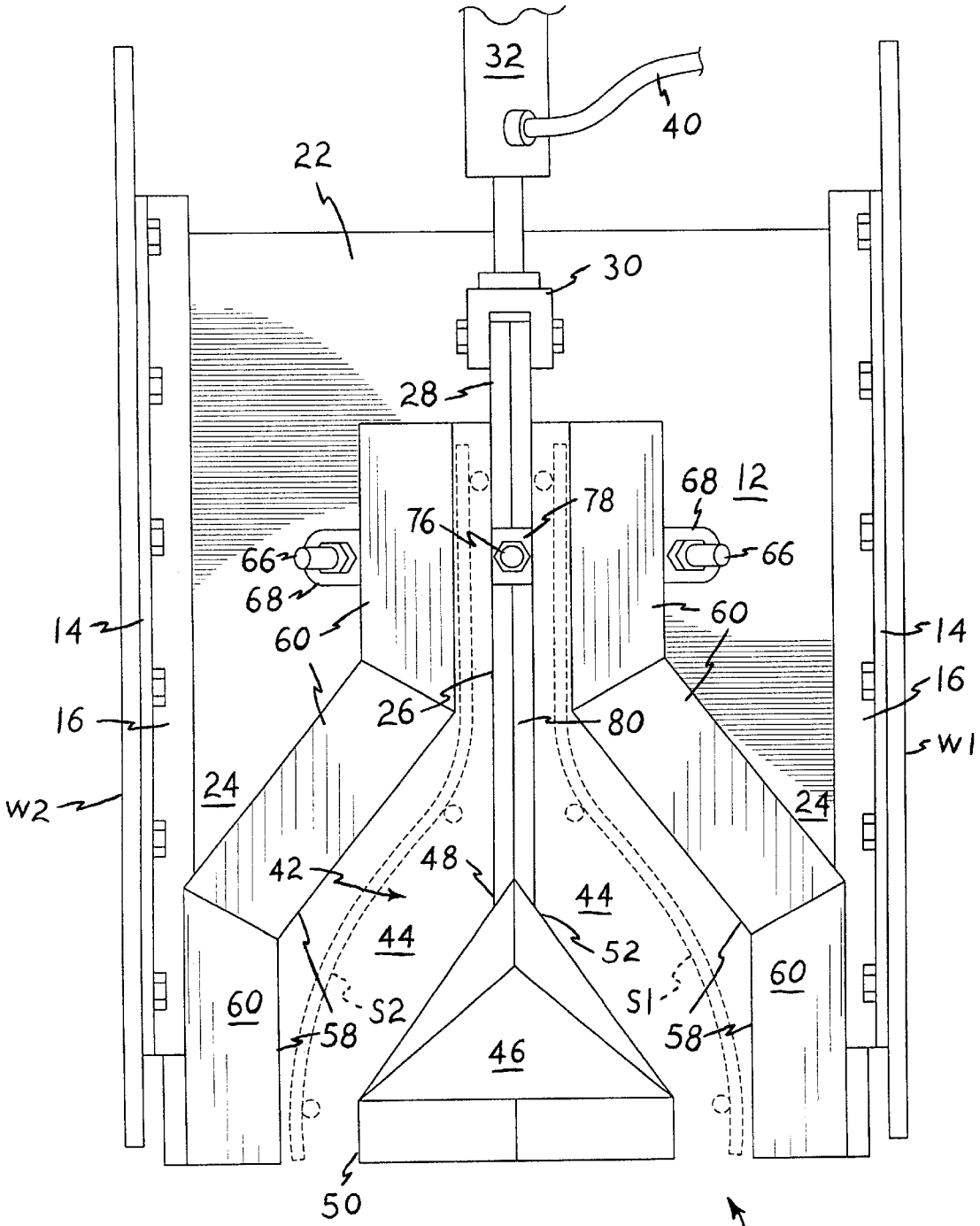
FIG. 4 is a front elevation view of the present guide.
Figure 5:
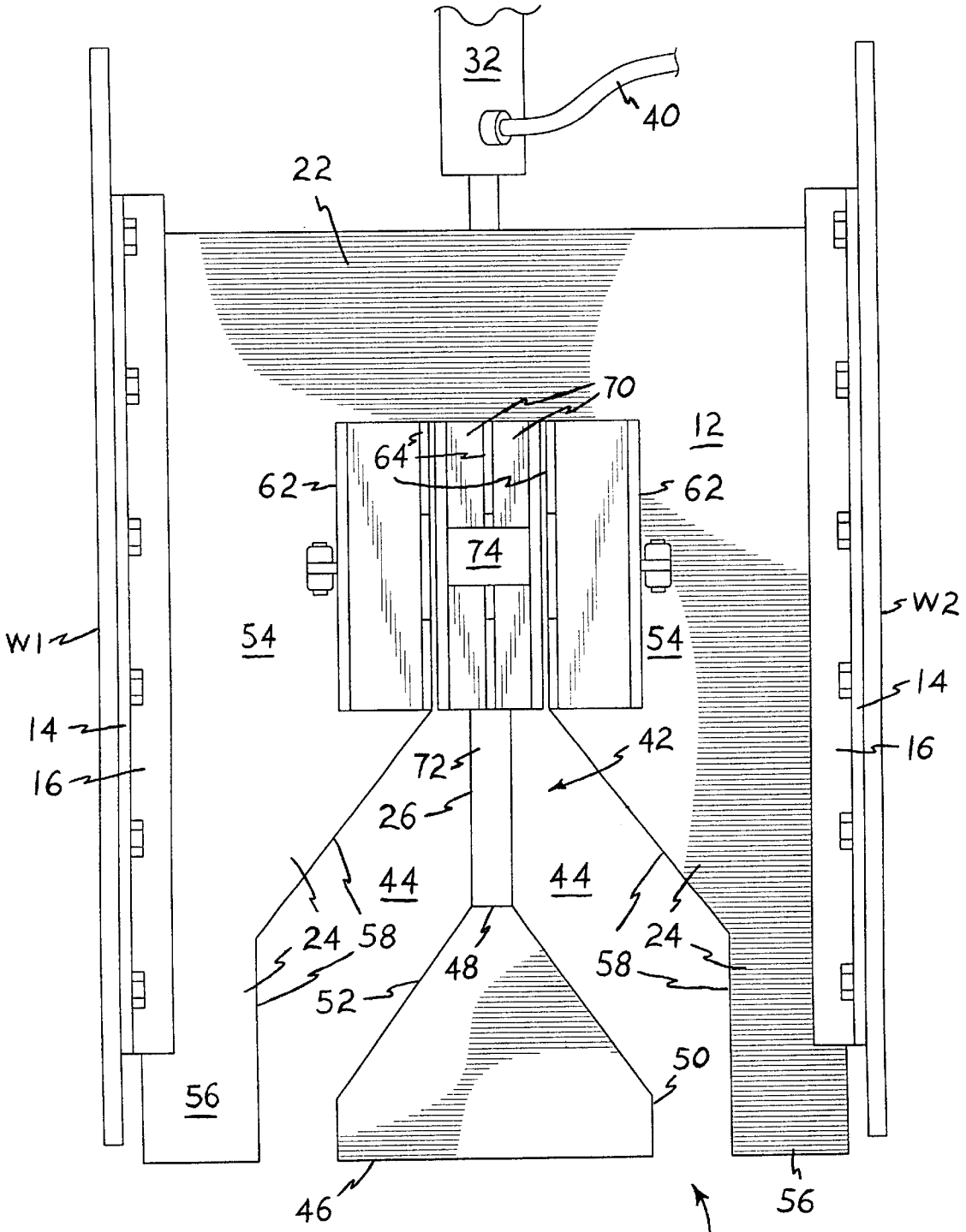
FIG. 5 is a rear elevation view of the present guide.

The two separate lower side panels 24 of the slide gate 12 define a reinforcement screen passage 42 therebetween, with the substantially medially positioned guide blade 26 separating the reinforcement screen passage 42 into two substantially equal first and second reinforcement screen guide slots 44; this is shown most clearly in the front and rear elevation views of FIGS. 4 and 5.

It will be noted that the reinforcement screen passage 42 has a wider lower portion, for accommodating a guide shoe 46 which is secured (welded, etc.) to the lower or guide shoe attachment end 48 of the guide blade 26 and extends downwardly therefrom. The guide shoe 46 has a width which is substantially wider than the width of the guide blade 26, as shown clearly in FIGS. 2, 4, and 5. The guide shoe 46 includes a relatively wide lower portion 50 with a tapered upper portion 52, which joins the guide shoe attachment end of the relatively narrow or thin guide blade 26.

Each of the lower side panels 24 of the slide gate 12 includes an upper portion 54 and a lower portion 56, with each upper portion 54 tapering outwardly into its respective lower portion 56 to form the reinforcing screen passage 42 which becomes wider at its lower end, generally in the cross sectional configuration (but narrower) of a typical concrete barrier which might be formed by a machine with which the present invention is used. The outwardly tapering side panels 24 of the slide gate 12, along with the wider lower portion 50 of the guide shoe 46, results in each of the reinforcing screen guide slots 44 having an essentially constant width, but being spread further from one another at their lower ends.

The inner edges 58 of the slide gate lower side panel portions 24, define the maximum width or spacing for two plies of steel reinforcing screen or mesh, e. g. first and second screens S1 and S2 shown in FIGS. 1 and 4 of the drawings, over which the present insertion guide 10 passes as the associated mobile concrete barrier forming machine advances. In order to guide the insertion guide 10 over the screens S1 and S2 more smoothly, at least one (preferably a series of) outboard front guide panel 60 is provided. This panel or panels 60 is welded or otherwise securely affixed to the inner edges 58 of the lower side panels 24 of the slide gate 12, and extends forwardly and is angled outwardly to guide or "funnel" the reinforcing screens S1 and S2 into their respective guide slots 44.

Figure 2:
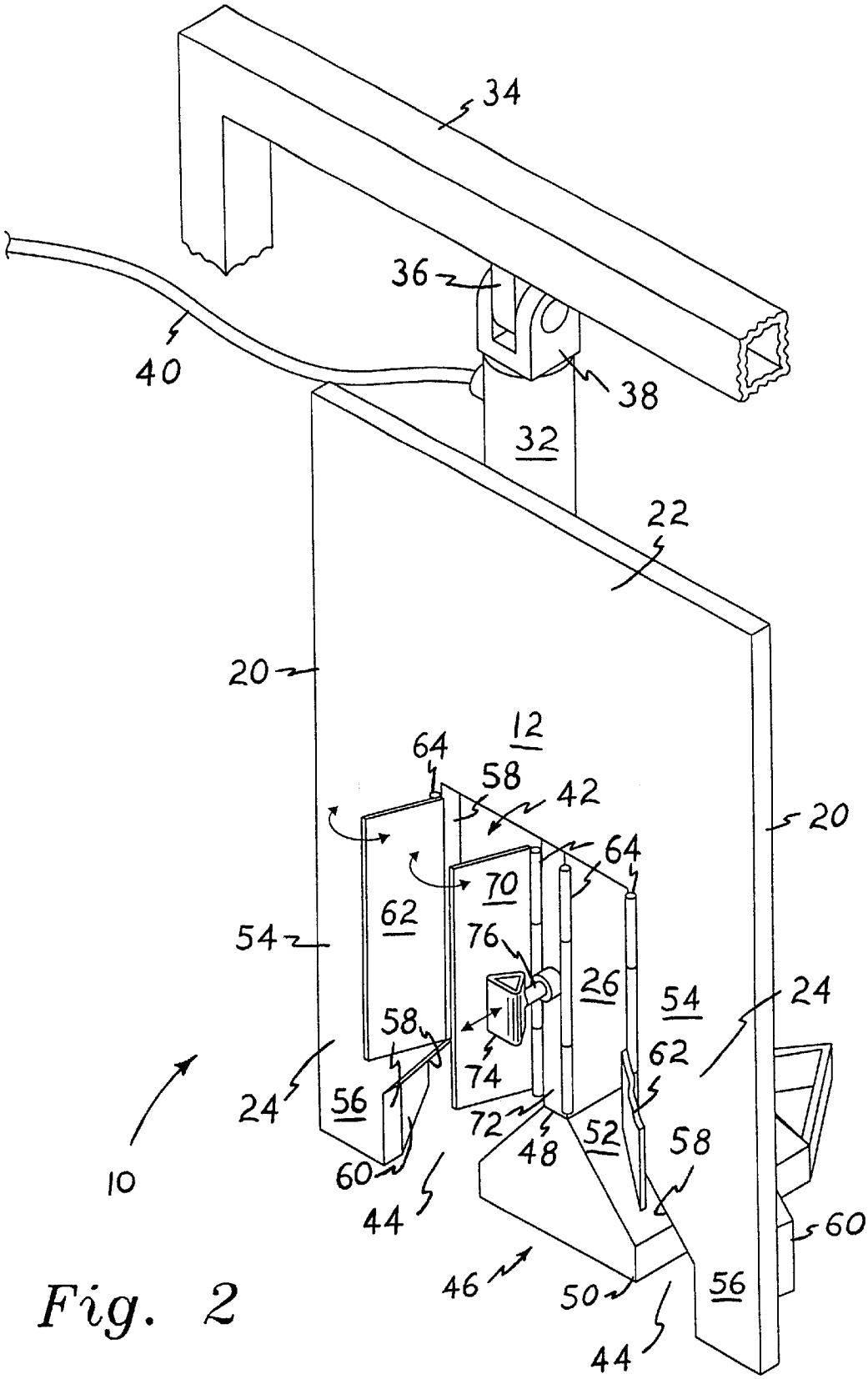
FIG. 2 is a rear and right side perspective view of the guide, showing further features thereof.
Figure 3:
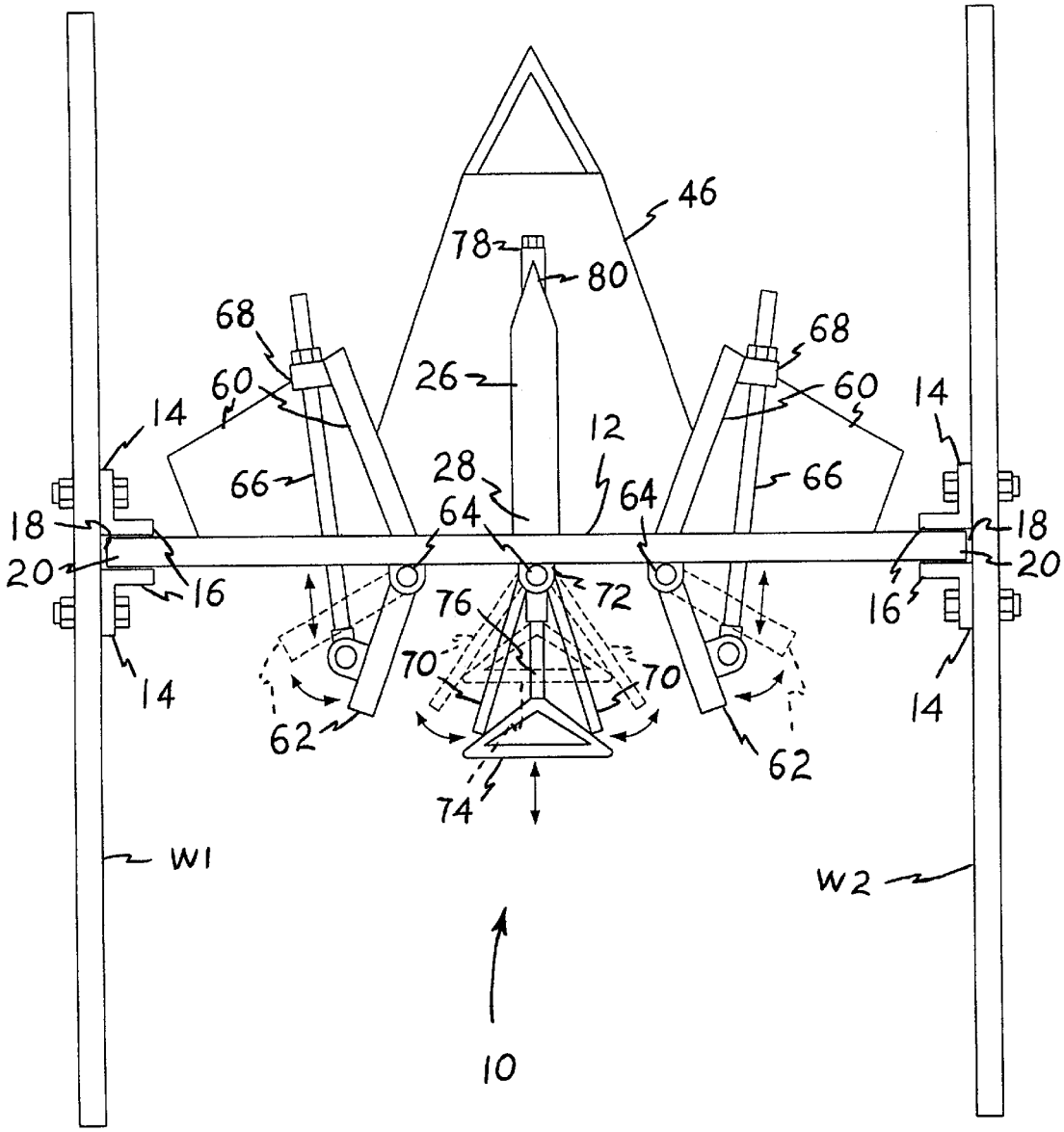
FIG. 3 is a top plan view of the present guide, showing further details thereof.

In a similar manner, additional rearwardly disposed outboard guide panels 62 may be installed along the inner edges 58 of the lower side panels 24 of the slide gate 12 as well, as shown in FIGS. 2, 3, and 5. These outboard rear guide panels 62 may be immovably fixed in position, or may alternatively and preferably be made to be laterally adjustable. Each of the outboard rear panels 62 is movably secured to a respective upper inner edge 58 of the slide gate lower side panels 24 by a hinge 64 or other suitable means. A threaded adjustment rod 66 extends forwardly from each outboard rear panel 64, through the slide gate 12 to an anchor point 68 disposed upon each outboard front panel 60. The threaded rods 66 enable the outboard rear panels 63 to be adjusted as desired to control the spacing of the upper portions of the reinforcing screens S1 and S2 from one another as desired.

The above described adjustable outboard rear panels 62 control the spread of the upper portions of the reinforcing screen material S1 and S2 as it feeds through the reinforcement insertion guide 10. However, these outwardly disposed rear panels 62 cannot urge the screens S1 and S2 farther apart. It will be seen that the desired spacing of the screens S1 and S2 at any given height, will depend upon the dimensions of the concrete barrier in which the screens S1 and S2 are being placed. In some instances, it may be desirable to position the upper edges of the screens S1 and S2 farther from one another, which cannot be accomplished by the outer rear panels 62.

Accordingly, the present invention provides additional rearwardly disposed inboard panels 70, which extend rearwardly from the trailing edge 72 of the guide blade 26 and are secured thereto by a single hinge 64 (FIGS. 3 and 5) or plural hinges 64 (FIG. 2). (It will be noted that one of the inboard rear panels 70, and a portion of one of the outboard rear panels 62, are not shown in FIG. 2, for clarity in the drawing Figure.) The inboard rear panels 70 have no means of positively positioning inwardly; inward control of the upper edge of the screens S1 and S2 is accomplished by the outboard rear panels 62. However, the inboard rear panels 70 may be urged laterally outwardly, by an adjustable wedge 74 or the like which extends rearwardly from the trailing edge 72 of the guide blade 26. A threaded adjustment rod 76 extends from the wedge 74, through the guide blade 26 (which may be formed of multiple sheets of material to provide a passage for the rod 76), to an anchor 78 at the leading edge 80 of the guide blade 26.

The present reinforcement insertion guide 10 is installed in a conventional mobile slip form concrete barrier wall forming machine, to provide accurate placement of steel reinforcement within the concrete barrier B as it is formed. The angles 16 are bolted or otherwise immovably affixed to the slip form walls W1 and W2 of the machine with the overhead frame being secured above the guide slots or channels 18 defined by the angles 16, generally as shown in FIG. 1 of the drawings. (Other means of providing such slots for the slide gate 12 may be provided as desired, e. g., a single U-shaped channel bolted, welded, etc. to each wall W1 and W2, etc.)

The outboard and inboard rear guide panels, respectively 62 and 70, are adjusted as desired by means of their respective adjusters 66 and 76 to control the spacing between the two plies of reinforcing steel S1 and S2. The adjusters 62 and 70 of the present guide 10 extend to the front of the slide gate 12, to position them clear of the plastic concrete as it is poured into the slip form mold behind the slide gate 12. Thus, adjustment of the rear guide panels 62 and 70 may be accomplished during operation of the slip form machine, if required.

The present reinforcement insertion guide 10 is adapted for guiding two laterally spaced reinforcement screens S1 and S2 into the plastic concrete in the slip form mold as the barrier B is being cast. However, it will be seen that the present guide 10 may be used to position a single ply of reinforcement screen within the barrier being formed, if so desired.

The screen or screens S1 and S2 are assembled beforehand, by tying or lacing together a series of generally horizontal and vertical reinforcement rods or bars, using wire ties T generally as shown in FIG. 1. This method of forming reinforcement screens is generally considered superior to welding the reinforcement rods or bars together, as such welding weakens the steel at the weld points and requires higher strength (and thus more costly) steel to be used. Also, trained welder and costly welding equipment is required when the steel is tied together to form the screens.

The use of ties T to secure the screens S1 and S2 together provides an additional benefit as well. By tying the two screens S1 and S2 together along their upper edges, the screens S1 and S2 may be stood upright, supported by their spread lower edges. They may be positioned along the intended location of the barrier B to be formed and the barrier forming machine guided along the desired route, with the present reinforcement insertion guide 10 guiding the screens S1 and S2 accurately between the two slip form mold walls W1 and W2 of the machine. As the ties T are formed of relatively light wire, they may be broken or cut relatively easily. Accordingly, the leading edge 80 of the guide blade 26 is sharpened or at least has a relatively sharp bevel thereon. When this sharpened leading edge 80 contacts the top ties TT which hold the two screens S1 and S2 together, the top ties TT are cut or broken by the guide blade 26, separating the two screens S1 and S2 to pass to each side of the blade 26. Further control of screen spacing is provided by the adjustable rear panels, as described further above.

In summary, the present reinforcement insertion guide provides a much needed advance in efficiency for installing reinforcement steel in a concrete barrier wall as the barrier is being formed. The present guide enables two plies of reinforcing screen or mesh to be erected along the intended path of the barrier wall, and automatically be fed into the slip form machine as the machine advances to form the barrier. Lateral adjustment of screen position or spacing is provided by means of the rearwardly disposed adjustable panels extending from the back of the slide gate of the device.

The present guide also provides clearance from various obstructions which are often encountered in the path of a concrete barrier as it is being formed. The hydraulic lift cylinder secured to the slide gate, allows the operator to lift or lower the slide gate within the slip form mold walls to adjust the height for clearance for curbs, catch basins, open cut joints, etc. While the present disclosure has provided hydraulic means for lifting and lowering the slide gate, it will be seen that other means (e. g., electrically powered screw jack, etc.) may be used alternatively if so desired. Moreover, the slide gate adjustment system may be adapted for automatic operation if so desired, by means of known, conventional sensing devices to control the lift of the hydraulic or other slide gate lift means. Thus, the present reinforcement insertion guide will be seen to provide significant advances in efficiency, and thus economy, in the field of continuously formed concrete barrier walls and similar concrete construction.

It is to be understood that the present invention is not limited to the sole embodiment described above, but encompasses any and all embodiments within the scope of the following claims.

I claim:

1. An adjustable insertion guide for guiding at least one essentially continuous steel reinforcement screen into a mobile slip form machine for forming continuous concrete barrier walls, said insertion guide comprising:

a generally vertically disposed slide gate;

means for securing said slide gate laterally and adjustably vertically between the opposed walls of a slip form mold of the slip form machine;

said slide gate having a laterally continuous upper portion with a first and a second lower side panel depending therefrom;

each said lower side panel defining a reinforcement screen passage therebetween;

generally vertically disposed reinforcement screen guide means depending centrally from said upper portion of said slide gate; and said reinforcement screen guide means dividing said reinforcement screen passage into substantially equal first and second reinforcement screen guide slots;

wherein each said lower side panel of said slide gate has an inner edge, and wherein the insertion guide further comprises either of at least one outboard front guide panel extending forwardly or at least one rear guide panel extending rearwardly from said inner edge of each said lower side panel of said slide gate.

2. The insertion guide according to claim 1, wherein said means for securing said slide gate laterally and adjustably vertically between the opposed walls of a slip form mold of the slip form machine, comprises:

said slide gate having a first lateral edge and a second lateral edge opposite said first edge;

opposite first and second slide gate slots disposed respectively upon the opposed walls of the slip form mold;

said first and said second lateral edge of said slide gate respectively slidably engaging said first and said second slide gate slots;

a lateral overhead frame spanning the slip form mold and extending across the walls thereof; and a hydraulic cylinder having a first end secured to said overhead frame, and a second end opposite said first end secured to said slide gate for adjusting said slide gate vertically.

3. The insertion guide according to claim 1, wherein said reinforcement screen guide means comprises:

a generally vertically disposed guide blade depending centrally from said upper portion of said slide gate, and orthogonal thereto;

said guide blade having an upper slide plate attachment end and a lower guide shoe attachment end opposite said upper slide plate attachment end;

a guide shoe secured to and extending from said lower guide shoe attachment end of said guide blade; and said guide blade and said guide shoe dividing said reinforcement screen passage into substantially equal first and second reinforcement screen guide slots.

4. The insertion guide according to claim 3, wherein:

said guide shoe has a width substantially greater than said guide blade;

said guide shoe having a tapered upper portion attaching to said lower guide shoe attachment end of said guide blade;

each said lower side panel of said slide gate having an upper portion and a lower portion, with each said upper portion tapering into the respective said lower portion; and each said lower side panel of said slide gate, said guide blade, and said guide shoe defining said first and second reinforcement screen guide slots each having a substantially constant width.

5. The insertion guide according to claim 1, further including:

means for laterally adjusting each said outboard rear guide panel for controlling passage of reinforcement screen therebetween.

6. The insertion guide according to claim 1, wherein:

said reinforcement screen guide means comprises at least a generally vertically disposed guide blade depending centrally from said upper portion of said slide gate, and orthogonal thereto;

said guide blade further including a trailing edge; and wherein the insertion guide further comprises a first and a second inboard rear guide panel extending rearwardly from said trailing edge of said guide blade.

7. The insertion guide according to claim 6, further including:

means for laterally adjusting each said inboard rear guide panel for controlling passage of reinforcement screen thereby.

8. An adjustable insertion guide for guiding at least one essentially continuous steel reinforcement screen into a mobile slip form machine for forming continuous concrete barrier walls, said insertion guide comprising:

a generally vertically disposed slide gate;

means for securing said slide gate laterally and adjustably vertically between the opposed walls of a slip form mold of the slip form machine;

said slide gate having a laterally continuous upper portion with a first and a second lower side panel depending therefrom;

each said lower side panel defining a reinforcement screen passage therebetween;

generally vertically disposed reinforcement screen guide means depending centrally from said upper portion of said slide gate; and said reinforcement screen guide means dividing said reinforcement screen passage into substantially equal first and second reinforcement screen guide slots;

said reinforcement screen guide means includes at least a generally vertically disposed guide blade depending centrally from said upper portion of said slide gate, and orthogonal thereto; and said guide blade further includes a sharpened leading edge for separating plural reinforcement screens.

9. An insertion guide for guiding at least one essentially continuous steel reinforcement screen into a mobile slip form machine for forming continuous concrete barrier walls, said insertion guide comprising:

a generally vertically disposed slide gate;

means for securing said slide gate laterally between the opposed walls of a slip form mold of the slip form machine;

said slide gate having a laterally continuous upper portion with a first and a second lower side panel depending therefrom;

each said lower side panel defining a reinforcement screen passage therebetween;

a generally vertically disposed guide blade depending centrally from said upper portion of said slide gate, and orthogonal thereto;

said guide blade having an upper slide plate attachment end and a lower guide shoe attachment end opposite said upper slide plate attachment end;

a guide shoe secured to and extending from said lower guide shoe attachment end of said guide blade; and said guide blade and said guide shoe dividing said reinforcement screen passage into substantially equal first and second reinforcement screen guide slots.

10. The insertion guide according to claim 9, wherein said means for securing said slide gate laterally between the opposed walls of a slip form mold of the slip form machine, comprises:

said slide gate having a first lateral edge and a second lateral edge opposite said first edge;

opposite first and second slide gate slots disposed respectively upon the opposed walls of the slip form mold; and said first and said second lateral edge of said slide gate respectively engaging said first and said second slide gate slots.

11. The insertion guide according to claim 10, further including:

a lateral overhead frame spanning the slip form mold and extending across the walls thereof;

a hydraulic cylinder having a first end secured to said overhead frame, and a second end opposite said first end secured to said slide gate for adjusting said slide gate vertically; and wherein each said lateral edge of said slide gate is vertically adjustably slidably disposed within respective said first and said second slide gate slots, for adjustably positioning said slide gate by means of said hydraulic cylinder.

12. The insertion guide according to claim 9, wherein:

said guide shoe has a width substantially greater than said guide blade;

said guide shoe having a tapered upper portion attaching to said lower guide shoe attachment end of said guide blade;

each said lower side panel of said slide gate having an upper portion and a lower portion, with each said upper portion tapering into the respective said lower portion; and each said lower side panel of said slide gate, said guide blade, and said guide shoe defining said first and second reinforcement screen guide slots each having a substantially constant width.

13. The insertion guide according to claim 9, wherein each said lower side panel of said slide gate has an inner edge and wherein the insertion guide further comprises at least one outboard front guide panel extending forwardly from said inner edge of each said lower side panel of said slide gate.

14. The insertion guide according to claim 9, wherein each said lower side panel of said slide gate has an inner edge, and wherein the insertion guide further comprises at least one outboard rear guide panel extending rearwardly from said inner edge of each said lower side panel of said slide gate.

15. The insertion guide according to claim 14, further including:

means for laterally adjusting each said outboard rear guide panel for controlling passage of reinforcement screen therebetween.

16. The insertion guide according to claim 9, further including:

a trailing edge disposed upon said guide blade; and a first and a second inboard rear guide panel extending rearwardly from said trailing edge of said guide blade.

17. The insertion guide according to claim 16, further including:

means for laterally adjusting each said inboard rear guide panel for controlling passage of reinforcement screen thereby.

18. The insertion guide according to claim 9, further including:

a sharpened leading edge disposed upon said guide blade for separating plural reinforcement screens.

* * * * *